US007196273B2

(12) United States Patent
Tanaka et al.

(10) Patent No.: US 7,196,273 B2
(45) Date of Patent: Mar. 27, 2007

(54) FLAT CABLE, FLAT CABLE SHEET, AND FLAT CABLE SHEET PRODUCING METHOD

(75) Inventors: Naoki Tanaka, Kanagawa (JP); Takanori Washiro, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/075,074

(22) Filed: Mar. 8, 2005

(65) Prior Publication Data

US 2005/0200557 A1 Sep. 15, 2005

(30) Foreign Application Priority Data

Mar. 9, 2004 (JP) ..... P2004-065146

(51) Int. Cl.
*H01B 7/00* (2006.01)

(52) U.S. Cl. ..... 174/117 R; 174/117 F; 174/117 FF

(58) Field of Classification Search ..... 174/28, 174/102 R, 105 R, 106 R, 110 R, 117 F, 174/117 FF, 120 R
See application file for complete search history.

(56) References Cited

U.S. PATENT DOCUMENTS 3,612,744 A * 10/1971 Thomas ..... 174/36
3,763,306 A * 10/1973 Marshall ..... 174/115
4,481,379 A * 11/1984 Bolick et al. ..... 174/36
4,551,576 A * 11/1985 Rich ..... 174/36
4,616,102 A * 10/1986 Noorily ..... 174/36
4,642,480 A * 2/1987 Hughes et al. ..... 307/147
4,652,772 A * 3/1987 Shephard ..... 307/147
4,698,457 A * 10/1987 Bordbar ..... 174/36
4,707,671 A * 11/1987 Suzuki et al. ..... 333/1
4,845,311 A * 7/1989 Schreiber et al. ..... 174/36
4,926,007 A 5/1990 Aufderheide et al.
4,972,041 A 11/1990 Crawley et al.
5,235,132 A * 8/1993 Ainsworth et al. ..... 174/36
5,446,239 A * 8/1995 Mizutani et al. ..... 174/36
5,552,565 A * 9/1996 Cartier et al. ..... 174/117 F
5,554,825 A * 9/1996 Parker et al. ..... 174/117 F
5,804,768 A * 9/1998 Sexton ..... 174/117 F
6,316,104 B1 * 11/2001 Kumakura ..... 428/375
6,486,394 B1 * 11/2002 Schmidt et al. ..... 174/36
6,633,001 B2 * 10/2003 Gasque, Jr. ..... 174/108
6,738,264 B2 * 5/2004 Takagi ..... 361/814
6,822,168 B2 * 11/2004 Klesing et al. ..... 174/254

FOREIGN PATENT DOCUMENTS

EP 1 453 068 A 9/2004
JP 11-162267 A 6/1999
JP 2001-135974 A 5/2001
JP 2002-111233 A 4/2002

* cited by examiner

*Primary Examiner*—William H. Mayo, III
(74) *Attorney, Agent, or Firm*—Lerner, David, Littenberg, Krumholz & Mentlik, LLP

(57) ABSTRACT

A flat cable includes a signal line extending in a longitudinal direction, a thin dielectric sheet with which the signal line is coated and that has plasticity, a pair of spaced apart ground layers extending in the longitudinal direction and sandwiching the dielectric sheet in its thickness direction, and insulators that coat the pair of ground layers so that they are not exposed to the outside. The cross-sectional size of the signal line in a direction orthogonal to the longitudinal direction, the thickness and width of the dielectric sheet, and so forth are selected to obtain a predetermined characteristic impedance for the cable. Each of the pair of ground layers is sized so as to be substantially wider than the signal line.

27 Claims, 15 Drawing Sheets

FLAT CABLE, FLAT CABLE SHEET, AND FLAT CABLE SHEET PRODUCING METHOD

CROSS-REFERENCE TO RELATED APPLICATIONS

The present application claims priority from Japanese Application No. 2004-065146 filed Mar. 9, 2004, the disclosure of which is hereby incorporated by reference herein.

BACKGROUND OF THE INVENTION

The present invention relates to a flat cable and a flat cable producing method, in particular, to a flat cable that can be produced at low cost and that can be densely mounted.

In recent years, as various types of electronic devices that generate radio frequency signals have been developed, their use has become widespread. As a result, many electronic apparatuses are being used in offices and homes. These electronic apparatuses use coaxial cables as radio frequency signal cables.

FIG. 1 shows the structure of a conventional coaxial cable. Disposed at the center of a coaxial cable 120 is a signal line 121. Disposed around the signal line 121 is a dielectric substance 122. Disposed around the dielectric substance 122 is a ground layer 123. The outermost periphery of the coaxial cable is coated with an insulator 124. Since the cross-section of the coaxial cable 120 is circular, it cannot be flattened. Consequently, the coaxial cable 120 has a large diameter. Thus, the coaxial cable 120 cannot be densely mounted. In addition, since these layers should be cylindrically formed and deposited, a complicated production process is required. It is therefore difficult to decrease the production cost of the coaxial cable 120.

To solve the foregoing problem, Japanese patent laid-open publication No. 2001-135974 and Japanese patent laid-open publication No. HEI 11-162267 propose structures for mounting a plurality of signal lines in flat cables using liquid crystal polymer.

However, the flat cables disclosed in these Japanese patent publications cannot be suitably used for transmitting radio frequency signals. In this case, the sizes of the cross-sections of the signal lines, the thicknesses of the dielectric substances, and so forth should be adjusted so that a predetermined characteristic impedance can be obtained and insertion loss can be decreased. In addition, the ground layer should be sufficiently wider than the signal line so as to prevent signals from leaking out of the cable.

In addition, Japanese patent laid-open publication No. 2002-111233 discloses a method for forming a radio frequency transmission line on a printed circuit board. In this method, however, since the transmission lines cannot be freely bent, the method cannot be used for cables.

SUMMARY OF THE INVENTION

Therefore, an object of the present invention is to provide a flat cable that can be flexibly wired. Another object of the present invention is to adjust the size of the cross-section of a signal line for a designated characteristic impedance and to provide a flat cable having a sufficiently wider ground layer than the signal line.

In addition, a further object of the present invention is to provide a flat cable that can be produced at low cost.

A first aspect of the present invention is a flat cable, including a signal line extending in a longitudinal direction and having an outer periphery; a dielectric sheet extending in the longitudinal direction to surround the outer periphery of the signal line, the dielectric sheet having a dimension in a width direction orthogonal to the length direction and a dimension in a thickness direction orthogonal to the longitudinal direction; a pair of spaced apart ground layers extending in the longitudinal direction and sandwiching the dielectric sheet in the thickness direction; and a first insulator extending in the longitudinal direction to coat the pair of ground layers so that the pair of ground layers are not exposed to the outside.

A second aspect of the present invention is a flat cable, including a dielectric sheet extending in a longitudinal direction; a first ground layer formed on the dielectric sheet and extending substantially in the longitudinal direction; a second ground layer formed on the dielectric sheet and extending substantially in the longitudinal direction, the second ground layer being spaced apart from the first ground layer; a signal line formed in the dielectric sheet and extending substantially in the longitudinal direction, the signal line being formed between and spaced apart from the first and second ground layers; a first insulator formed on a first side of the dielectric sheet so as to cover the signal line, the first ground layer and the side of the dielectric sheet opposite the first side.

A third aspect of the present invention is a flat cable sheet, including a plurality of spaced apart signal lines extending in a longitudinal direction, each signal line having an outer periphery; a dielectric sheet extending in the longitudinal direction to surround the outer periphery of each of the signal lines, the dielectric sheet having a dimension in a width direction orthogonal to the longitudinal direction and a dimension in a thickness direction orthogonal to the longitudinal direction; a pair of spaced apart ground layers extending in the longitudinal direction and sandwiching the dielectric sheet in the thickness direction; and an insulator extending in the longitudinal direction to coat the pair of ground layers so that the pair of ground layers are not exposed to the outside.

A fourth aspect of the present invention is a flat cable sheet, including a plurality of spaced apart signal lines extending in a longitudinal direction, each signal line having an outer periphery; a dielectric sheet extending in the longitudinal direction to surround the outer periphery of each of the signal lines, the dielectric sheet having a dimension in a width direction orthogonal to the longitudinal direction and a dimension in a thickness direction orthogonal to the longitudinal direction; a pair of spaced apart ground layers extending in the longitudinal direction and sandwiching the dielectric sheet in the thickness direction; a first insulator extending in the longitudinal direction to coat the pair of ground layers so that the pair of ground layers are not exposed to the outside; a pair of spaced apart shield layers extending in the longitudinal direction and sandwiching the first insulator in the thickness direction; and a second insulator extending in the longitudinal direction to coat the pair of shield layers so that the pair of shield layers are not exposed to the outside.

A fifth aspect of the present invention is a method for producing a flat cable sheet, including providing a first dielectric layer; depositing a first metal film on a first surface of the first dielectric layer; etching the first metal film to define a plurality of signal lines that extend substantially parallel to one another in a longitudinal direction; depositing a second dielectric layer on an exposed surface of the etched metal film; depositing a second metal film over the second dielectric layer; etching the second metal film to define a first plurality of spaced apart ground layers extending in the longitudinal direction, each of the ground layers in the first plurality of ground layers overlying one of the signal lines; depositing a first insulator on an exposed surface of each of the ground layers in the first plurality of ground layers; depositing a third metal film on a second surface of the first dielectric layer opposite the first surface; etching the third metal film to define a second plurality of spaced apart ground layers extending in the longitudinal direction, each of the ground layers in the second plurality of ground layers underlying one of the signal lines; and depositing a second insulator on an exposed surface of each of the ground layers in the second plurality of ground layers.

According to the present invention, the size of the cross-section of a signal line, the thickness of the dielectric layer and so forth are selected to obtain a predetermined characteristic impedance for the cable. In addition, a flat cable composed of a ground layer that is sufficiently wider than a signal line and a dielectric sheet that has plasticity can be produced at low cost. When such a flat cable is used for an electronic apparatus, it can be miniaturized.

In a small mobile apparatus that has a radio communication function, for example, a personal digital assistant, an antenna is disposed at an upper portion of a liquid crystal display (inside a liquid crystal panel) so as to increase signal transmission/reception sensitivity against an access point. A radio communication module may be disposed below a keyboard. The flat cable according to the present invention can be used to connect the antenna and the radio communication module. A radio frequency signal as high as 2.4 GHz is transmitted between the antenna and the radio communication module. In recent years, although mobile apparatuses have been miniaturized, with this flat cable, the radio communication function can be mounted in a small space of a mobile apparatus.

In addition, since the flat cable according to the present invention is a ribbon type cable, it needs a small space to mount. With the flat cable, a liquid crystal panel can be bent. Moreover, the flat cable can be mounted in a very limited space.

These and other objects, features and advantages of the present invention will become more apparent in light of the following detailed description of a best mode embodiment of the invention, as illustrated in the accompanying drawings.

BRIEF DESCRIPTION OF THE DRAWINGS

The invention will become more fully understood from the following detailed description, taken in conjunction with the accompanying drawings, wherein similar reference numerals denote similar portions, in which:

FIG. 14A and FIG. 14B are front and sectional views, respectively, showing the structure of a flat cable according to a seventh embodiment of the present invention.

DETAILED DESCRIPTION

A flat cable according to the present invention is a transmission line that transmits a radio frequency signal and that is produced by forming a signal line in or on the front surface of a bendable (flexible) dielectric substance (sheet), such as a liquid crystal polymer or Teflon (trademark of E.I. Du Pont de Nemours and Company) substrate, and forming a ground layer made of a metal spaced from the signal line by the dielectric substance. Alternatively, two ground layers may be formed on the front surface of the dielectric sheet with a signal line between the two ground layers.

To transmit a radio frequency signal with a small transmission loss, the characteristic impedance of the signal transmission line needs to be a predetermined value, for example 50Ω. The characteristic impedance of the transmission line depends on the shape of the signal line, the relative dielectric constant of the dielectric substance, and so forth. To prevent a signal from leaking out of the cable, the ground layer needs to be sufficiently wider than the signal line. To suppress the radiation of a signal from the cable and the influence of external electromagnetic noise against the signal line, it is effective to coat a transmission line in which the signal line and the ground line are paired with a shield layer made of a metal.

Next, embodiments of the present invention will be described. These embodiments have been made in consideration of the foregoing conditions.

(First Embodiment)

Figure 1:
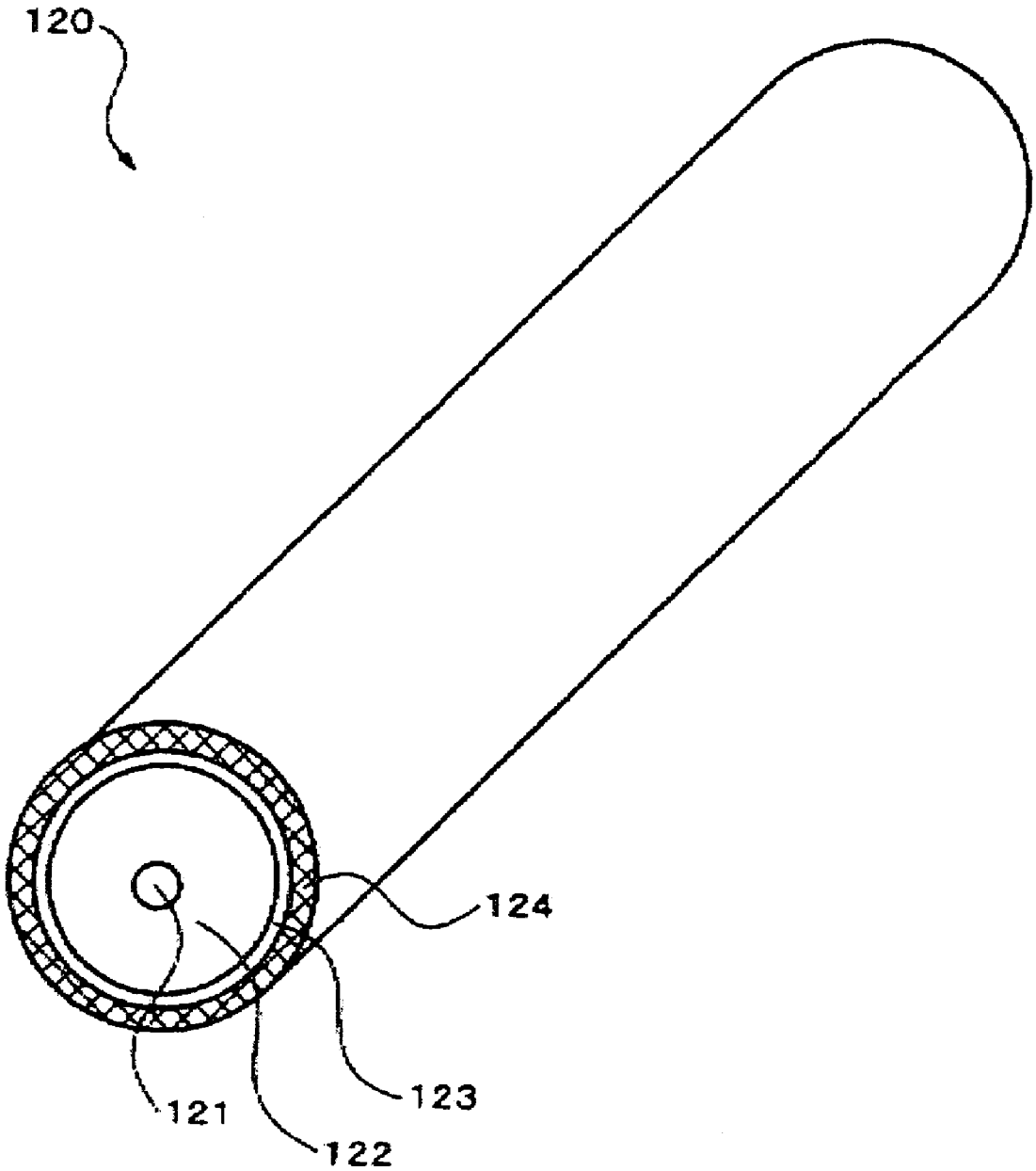
Fig. 1 (PRIOR ART)
FIG. 1 is a perspective view showing the structure of a conventional coaxial cable.
Figure 2:
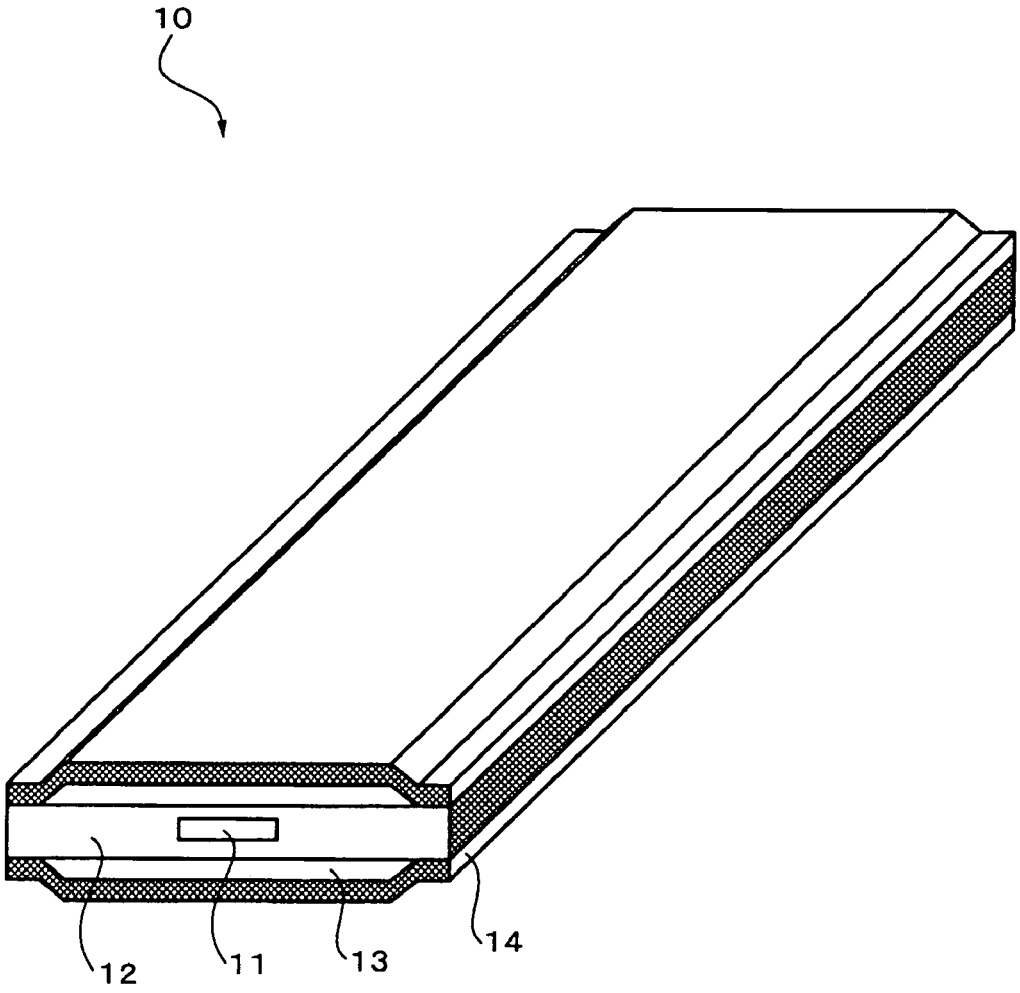
FIG. 2 is a perspective view showing the structure of a flat cable according to a first embodiment of the present invention.

FIG. 2 shows the structure of a flat cable according to a first embodiment of the present invention. In FIG. 2, a cable 10 is a radio frequency cable that has a strip line structure. Since this cable is flat, it can be more flattened than conventional coaxial cables. In addition, when the dielectric substance is thinned and the ground layer is sufficiently wider than the signal line, the radiation of a signal from the side portion free of the ground layer can be suppressed. The characteristic impedance depends on the size of the cross-section of the signal line, the specific dielectric constant of the dielectric substance, and so forth. In this example, the flat cable is designated to have a characteristic impedance of 50Ω.

More particularly, the cable 10 is structured so that a signal line 11 is coated with a thin dielectric sheet 12 and ground layers 13 are formed on an upper surface and a lower surface of the dielectric sheet 12, the ground layers 13 being sufficiently wider than the signal line 11. To prevent a current from unnecessarily shortcircuiting through the ground layers 13, the upper and lower surface of the cable are coated with films of an insulator 14. The two ground layers are coated with two films of the insulator 14 so that the ground layers are not exposed to the outside. Thus, the side portions of the cable 10 are composed of the dielectric sheet 12 and the insulator 14.

The dielectric sheet 12 is made of a material having plasticity. Thus, since the cable 10 can be relatively freely bent, it can be used for a complicated line and an open/close mechanism.

Figure 3:
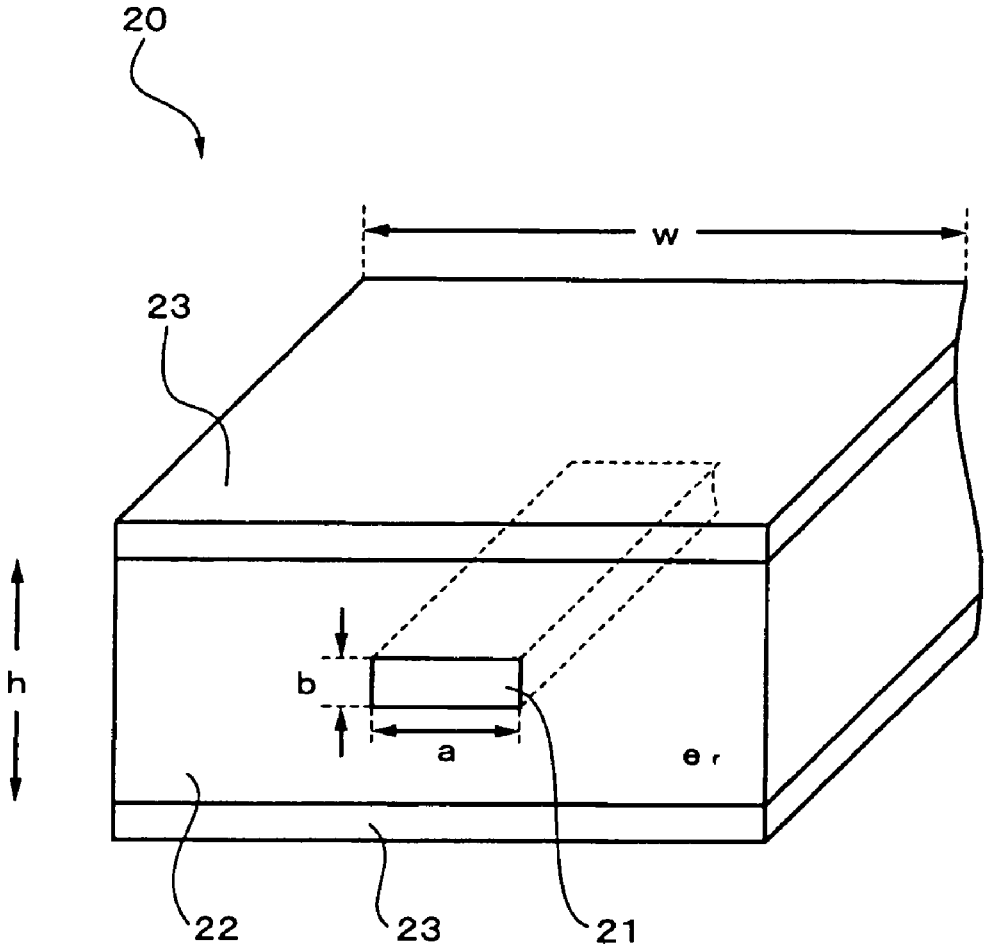
FIG. 3 is an exploded perspective view showing the structure of a strip line.

Next, a method for obtaining the characteristic impedance of a strip line such as the cable 10 according to the first embodiment will be described. As described above, the cable 10 is designed to have a characteristic impedance of, for example, 50Ω. FIG. 3 schematically shows the structure of a strip line. A strip line 20 is composed of a signal line 21, a dielectric sheet 22, and upper and lower ground layers 23. The width of each of the ground layers 23 is denoted by w, the height of the dielectric sheet 22 is denoted by h, the width of the cross-section of the signal line 21 is denoted by a, the height thereof is denoted by b, and the relative dielectric constant of the dielectric sheet 22 is denoted by $\epsilon_r$.

If the width w of the ground layer 23 is sufficiently larger than the width a of the cross-section of the signal line 21, the characteristic impedance $Z_0$ can be approximately represented by the following formula 1.

$$Z_0=(60/\epsilon_r)^{1/2})ln(4h/(0.67\ \pi a(0.8+(b/a)))) \quad \text{Formula 1}$$

Figure 4A:
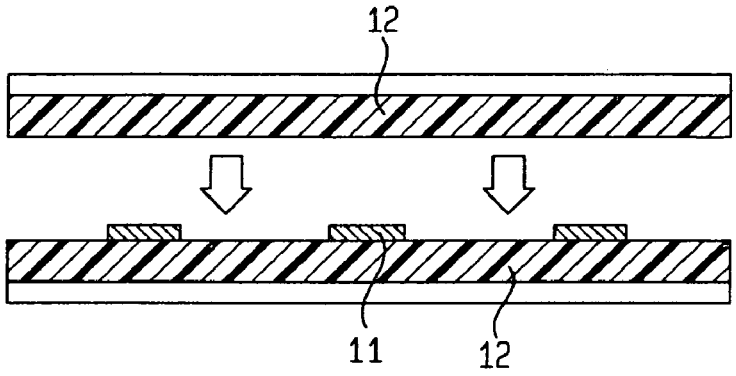
FIG. 4A, FIG. 4B and FIG. 4C are sectional views showing a method for producing the flat cable according to the first embodiment of the present invention.

FIG. 4A, FIG. 4B, FIG. 4C and FIG. 5 are sectional views showing a method for producing the flat cable according to the first embodiment of the present invention. In FIG. 4A, the signal line 11 is accurately formed by an etching process or the like. The upper and lower surfaces of the signal line 11 are coated with the dielectric sheets 12 and metal films. The material of the signal line 11 is, for example, copper.

Figure 4B:
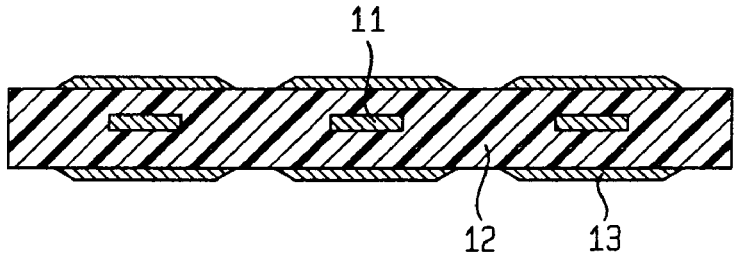

Next, as shown in FIG. 4B, the metal films are processed using an etching process or the like so as to form the ground layers 13. As described above, the ground layers 13 are processed so that each of them is sufficiently wider than the signal line 11.

Figure 4C:
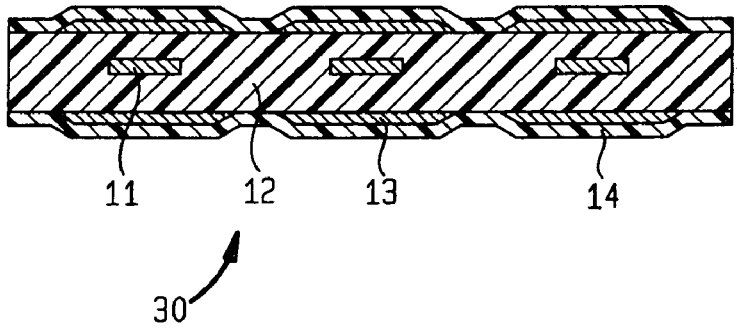

Finally, as shown in FIG. 4C, the insulators 14 are formed on the upper and lower ground layers 13. As a result, a flat cable sheet 30 having a plurality of cables is produced.

Figure 5:
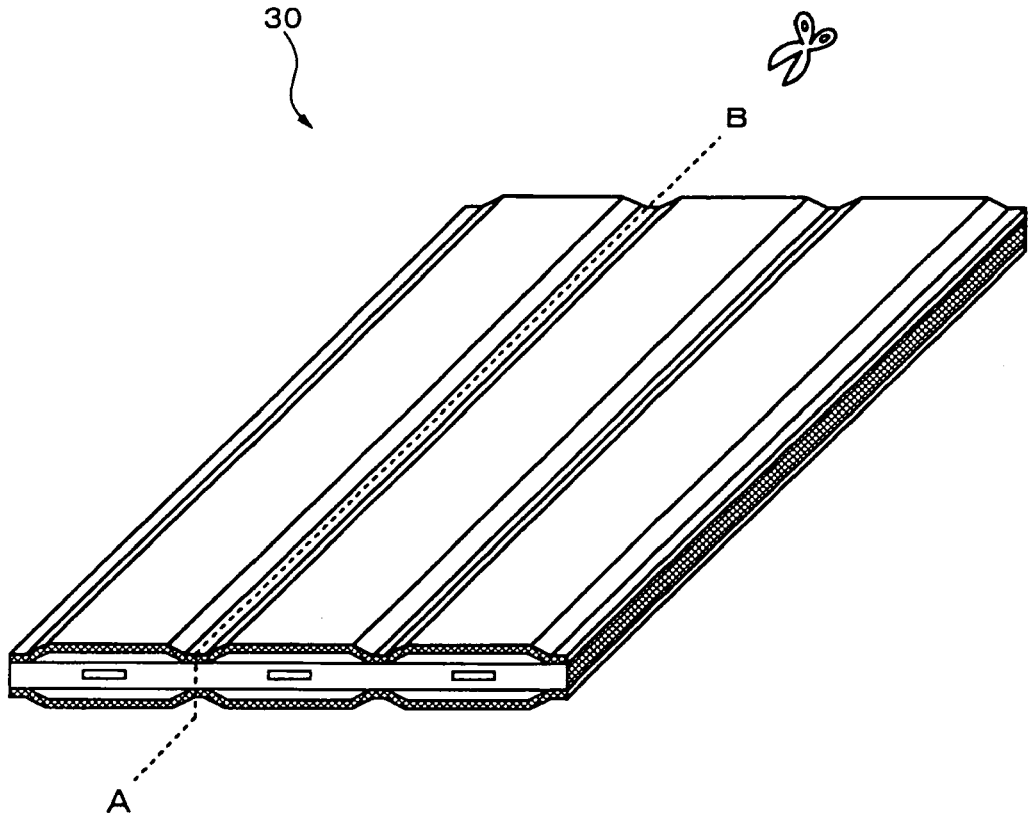
FIG. 5 a perspective view showing the method for producing the flat cable according to the first embodiment of the present invention.

Thereafter, the flat cable sheet 30 produced as shown in FIG. 4A to FIG. 4C is cut along line A–B shown in FIG. 5 several times. As a result, a plurality of flat cables 10 are obtained. In this method, radio frequency cables having excellent characteristics can be produced in quantity at low cost. It is preferred that each of the ground layers 13 should be narrower than the cut interval so that the ground layers 13 are not cut.

(Second Embodiment)

Figure 6:
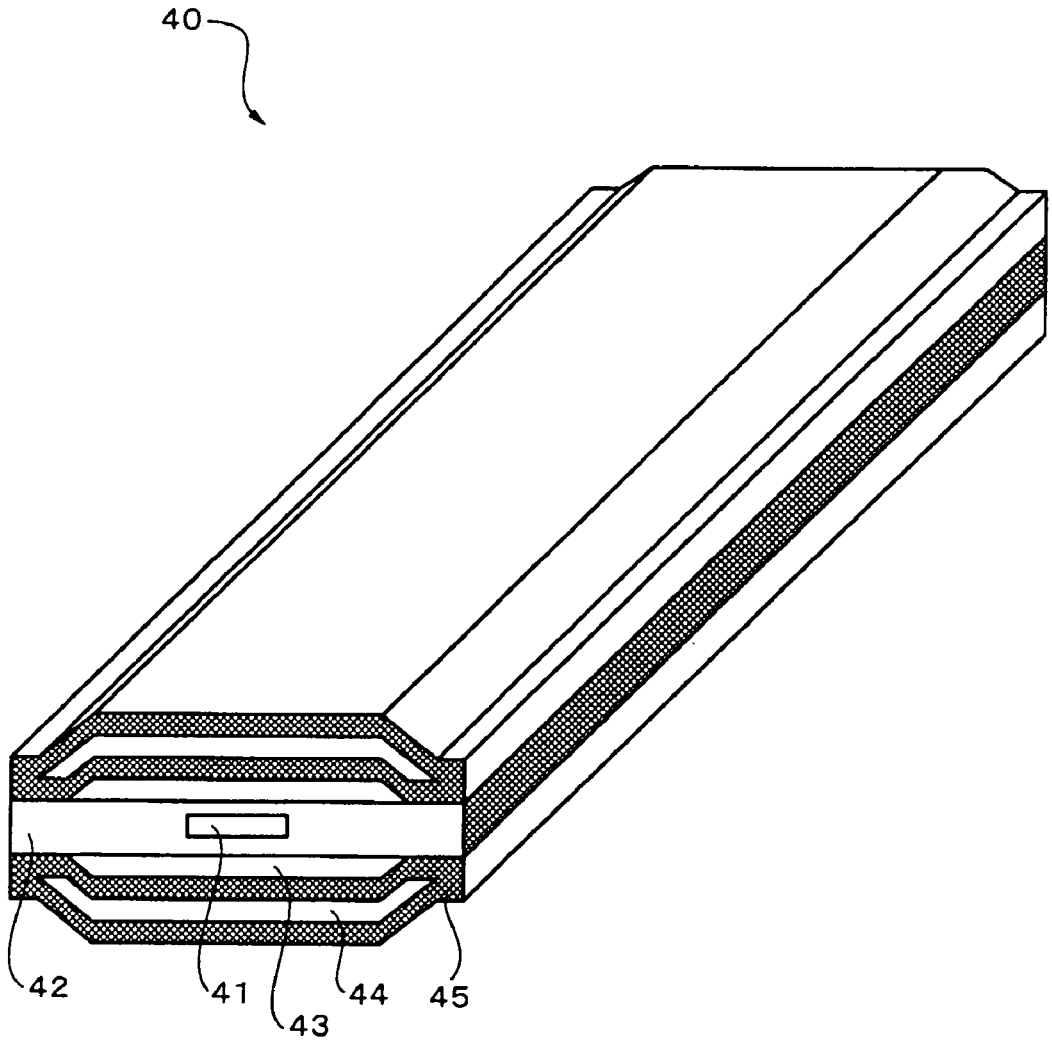
FIG. 6 is a perspective view showing a method for producing a flat cable according to a second embodiment of the present invention.

Next, with reference to FIG. 6, a flat cable according to a second embodiment of the present invention will be described. A cable 40 shown in FIG. 6 contains a signal line 41, a dielectric sheet 42, upper and lower ground layers 43, upper and lower shield layers 44, and upper and lower insulators 45. The signal line 41 is coated with the dielectric sheet 42. The upper and lower ground layers 43 are formed on the upper and lower surfaces of the dielectric sheet 42, respectively. Each of the ground layers 43 is sufficiently wider than the signal line 41. The upper and lower ground layers 43 are coated with the upper and lower insulators 45, respectively. The upper and lower shield layers 44 are formed on the upper and lower insulators 45, respectively. The upper and lower shield layers 44 are coated with the upper and lower insulators 45, respectively.

According to the second embodiment, the shield layers 44 and the insulators 45 are formed on the upper and lower surfaces of the cable 10 of the first embodiment. With the cable 40, the radiation of a signal is more suppressed than with the cable 10 of the first embodiment. Thus, the influence of external electromagnetic noise against the signal line can be more suppressed than in the first embodiment. In addition, the ground layers 43 and the shield layers 44 are not exposed to the outside. Thus, the side portions of the cable 40 are composed of the dielectric sheet 42 and the insulator 45.

The cable 40 is produced in the same method shown in FIG. 4A to FIG. 4C and FIG. 5, except that after the flat cable sheet 30 shown in FIG. 4A to FIG. 4C is produced, the shield layers 44 are formed and etched and then the outermost insulators 45 are formed. The dielectric sheet 42 is made of a material having, for example, plasticity.

(Third Embodiment)

Figure 7:
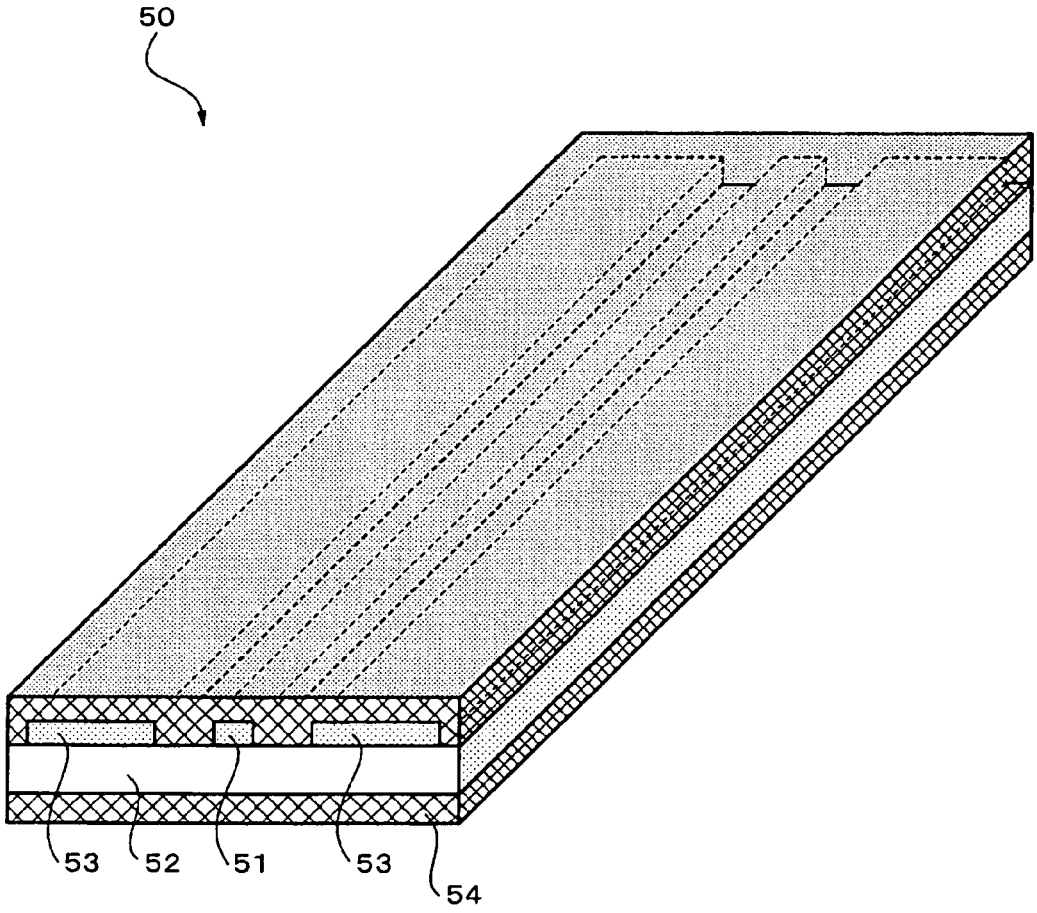
FIG. 7 is a perspective view showing the structure of a flat cable according to a third embodiment of the present invention.

Next, with reference to FIG. 7, a flat cable according to a third embodiment of the present invention will be described. A cable 50 shown in FIG. 7 is a cable having a coplanar structure in which a signal line 51 and two ground layers 53 are formed on the same plane (i.e., the surface of a dielectric sheet 52). Since the signal line 51 and the two ground layers 53 are formed on the same plane, namely on the dielectric sheet 52, the structure of this cable becomes simpler and it can be produced at lower cost than the foregoing cables.

The cable 50 is composed of a signal line 51, a dielectric sheet 52, two ground layers 53, and upper and lower insulators 54. As described above, the signal line 51 and the two ground layers 53 are formed almost in parallel in the longitudinal direction of the cable 50 so that the signal line 51 does not contact the two ground layers 53. In addition, the two ground layers 53 are formed on both sides of the signal line 51. In the cross-section perpendicular to the longitudinal direction of the cable 50, each of the ground layers 53 is sufficiently wider than the signal line 51.

The upper and lower surfaces of the signal line 51, the dielectric sheet 52, and the two ground layers 53 are coated with the upper and lower insulators 54, respectively.

The cable 50 can be produced in the same method as the foregoing embodiments shown in FIG. 4A to FIG. 4C, and FIG. 5. In this case, the signal line 51 and the two ground layers 53 are formed and etched in the same process as the foregoing embodiments. The dielectric sheet 52 is made of a material having, for example, plasticity.

Figure 8:
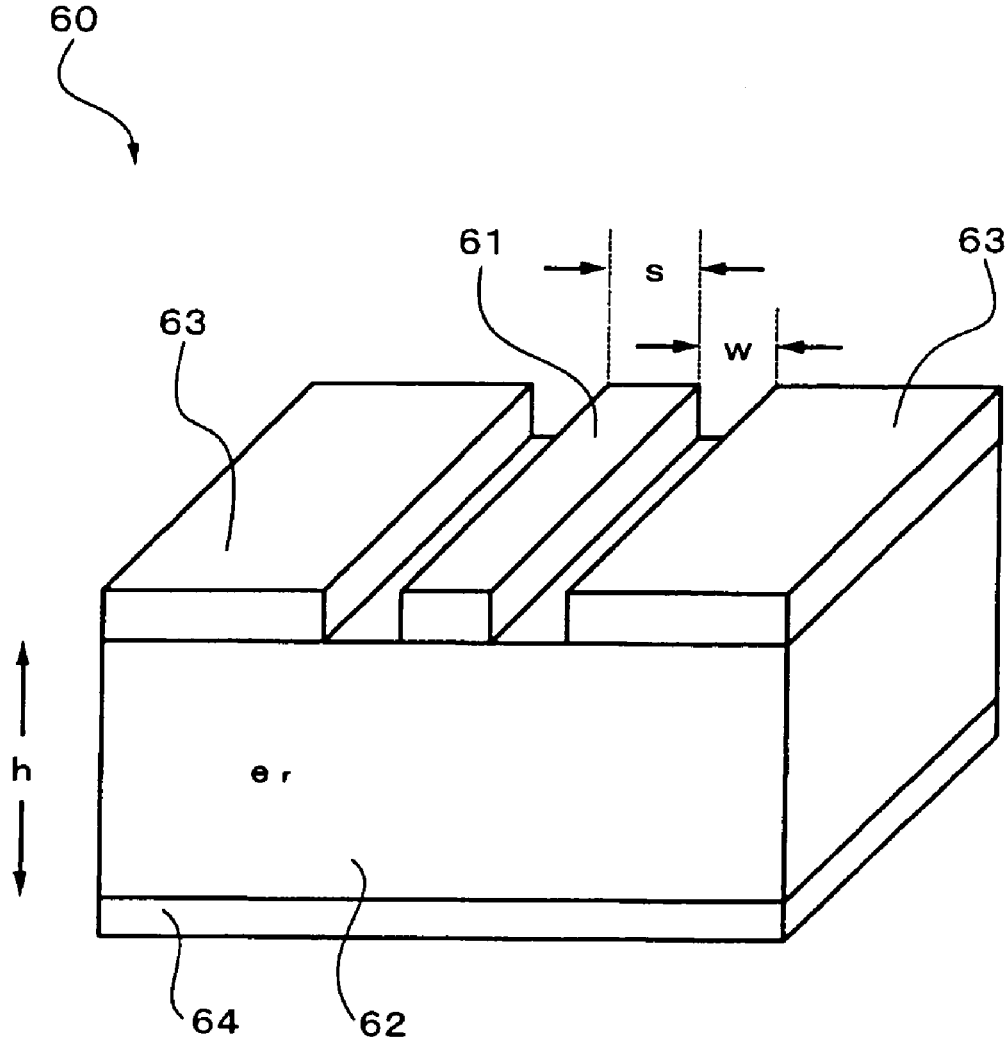
FIG. 8 is a perspective view showing the structure of a coplanar line.

The characteristic impedance of a coplanar line (or coplanar waveguide CPW) depends on the relative dielectric constant of the dielectric sheet that is used, the thickness and width of the conductor that is used, and so forth. When a dielectric sheet having a high relative dielectric constant is used, a miniaturized circuit can be accomplished. A coplanar waveguide 60 shown in FIG. 8 has the same structure as the cable 50 of the third embodiment. The coplanar waveguide 60 is composed of a signal line 61, a dielectric sheet 62, two ground layers 63, and an insulator 64. The relative dielectric constant of the dielectric sheet 62 is denoted by $\epsilon_r$, the thickness of the dielectric sheet 62 is denoted by h, the width of the cross-section of the signal line 61 (the width of the waveguide) is denoted by s, and the width between the signal line 61 and the ground layers 63 is denoted by w.

In this case, the characteristic impedance $Z_0$ can be approximately expressed by a predetermined formula based on these values. Alternatively, the characteristic impedance $Z_0$ can be calculated using a predetermined simulator.

(Fourth Embodiment)

Figure 9:
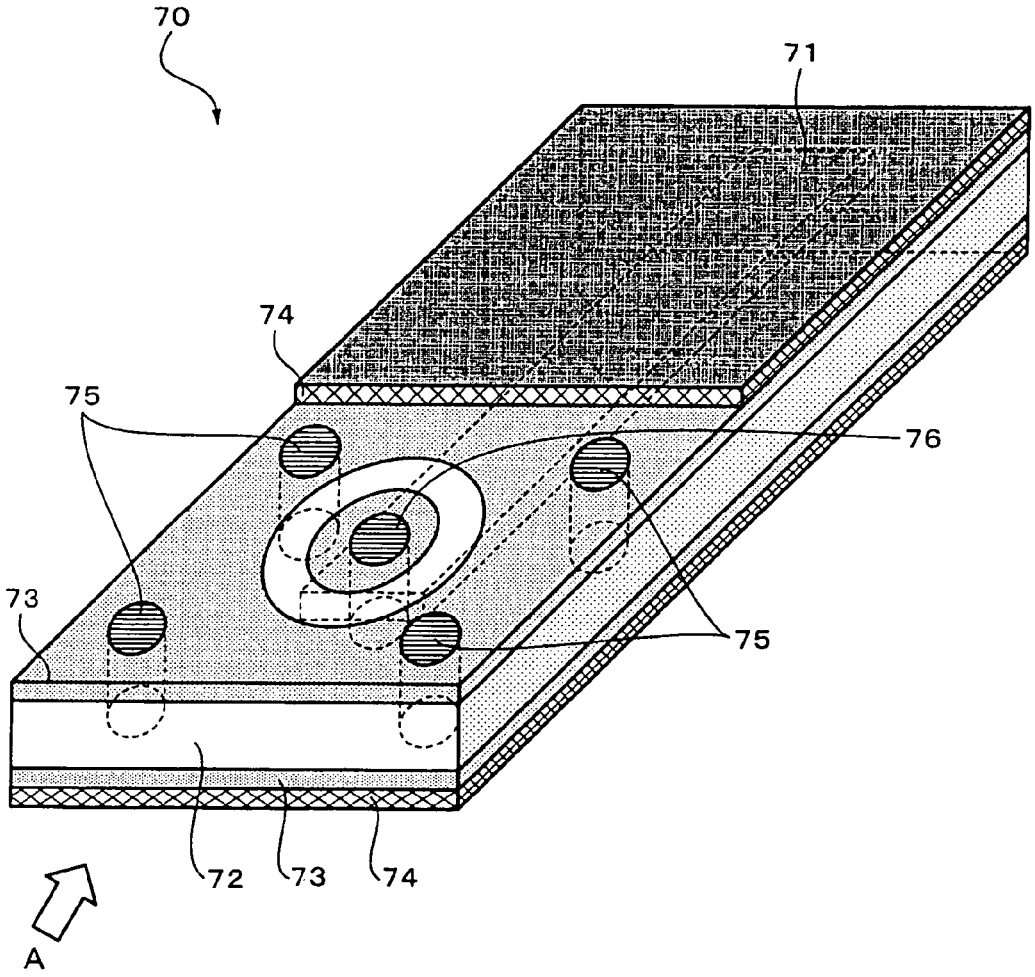
FIG. 9 is a perspective exploded view showing the structure of a flat cable according to a fourth embodiment of the present invention.

Next, with reference to FIG. 9, a flat cable according to a fourth embodiment of the present invention will be described. A cable 70 shown in FIG. 9 is part of an end portion (terminal portion) of a flat cable. The cable 70 is composed of a signal line 71, a dielectric sheet 72, upper and lower ground layers 73, and upper and lower insulators 74. The cable 70 has four through-holes 75 and one through-hole 76. Although the upper and lower ground layers 73 are exposed on the side portions of the cable 70, one of the flat cables of the first to third embodiments can be used.

An end portion of the upper ground layer 73 is not coated with the upper insulator 74 so that the end portion of the upper ground layer 73 can be electrically connected to a circuit board. The four through-holes 75 electrically connect the upper and lower ground layers 73. The through-hole 76 is formed as a terminal with which a signal from the signal line 71 may be connected to the outside. A terminal is disposed above the cable 70 shown in FIG. 9. In this example, four through-holes 75 are formed. However, the number of through-holes 75 is not limited to four. The through-holes 75 are formed so that the potentials of the upper and lower ground layers 73 become equal.

The through-holes can be formed by various methods. In one method, holes are made in two ground layers that sandwich a dielectric sheet having through-holes aligned with the holes in the ground layers. The aligned holes are filled with electro-conductive paste (for example, silver paste or copper paste) so as to electrically connect the two ground layers. In another method, the walls of the aligned holes are plated with an electro-conductive substance so as to electrically connect the two ground layers. In the example shown in FIG. 9, the first method is used.

The cable 70 can be produced in the same method as the first embodiment shown in FIG. 4A to FIG. 4C and FIG. 5. The through-holes 75 and the through-holes 76 are formed by a single process. The dielectric sheet 72 is made of a material having, for example, plasticity.

Figure 10:
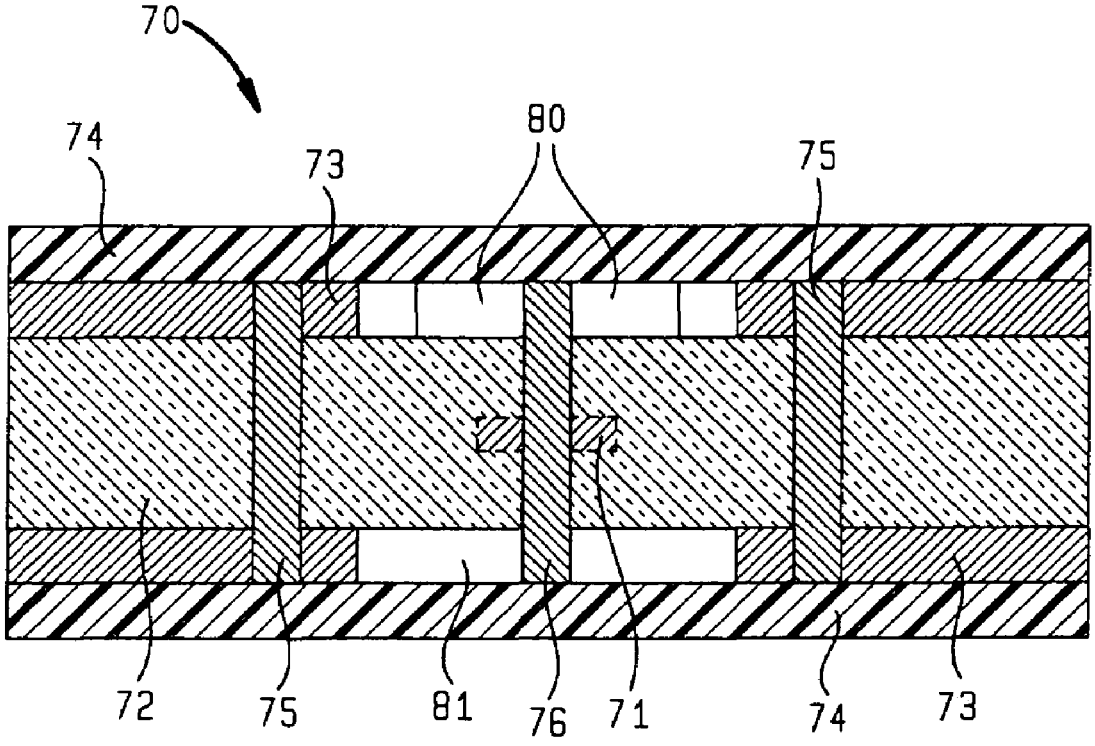
FIG. 10 is a sectional view showing the flat cable according to the fourth embodiment of the present invention, viewed from another direction.

FIG. 10 is a sectional view seen in the direction of arrow A shown in FIG. 9. The through-holes 75 extend from the upper ground layer 73 to the lower ground layer 73. The through-holes 75 electrically connect the upper ground layer 73 and the lower ground layer 73. Although the through-hole 76 extends from the upper ground layer 73 to the lower ground layer, a space portion 80 that is concentrically cut from the upper ground layer 73 around the through-hole 76 keeps it apart from the upper ground layer 73. A space portion 81 that is concentrically cut from the lower ground layer 73 around the through-hole 76 keeps it apart from the lower ground layer 73. Alternatively, the space portion 81 may be formed in the same shape as the space portion 80.

The through-hole 76 is connected to the signal line 71. In FIG. 10, the signal line 71 extends from the deeper side to the through-hole 76. With the cable 70 that has such a structure, by connecting a ground of a circuit board to any portion of the upper ground layer 73 external to the space portion 80 and connecting a signal input/output portion of the circuit board to any portion of the space portion 80 of the ground layer 73 interior of the space portion 80, the circuit board and the cable 70 are electrically connected. These connections are performed by, for example, soldering. Alternatively, the circuit board and the cable 70 can be mechanically contacted or connected by, for example, clamping.

(Fifth Embodiment)

Figures 11A, 11B:
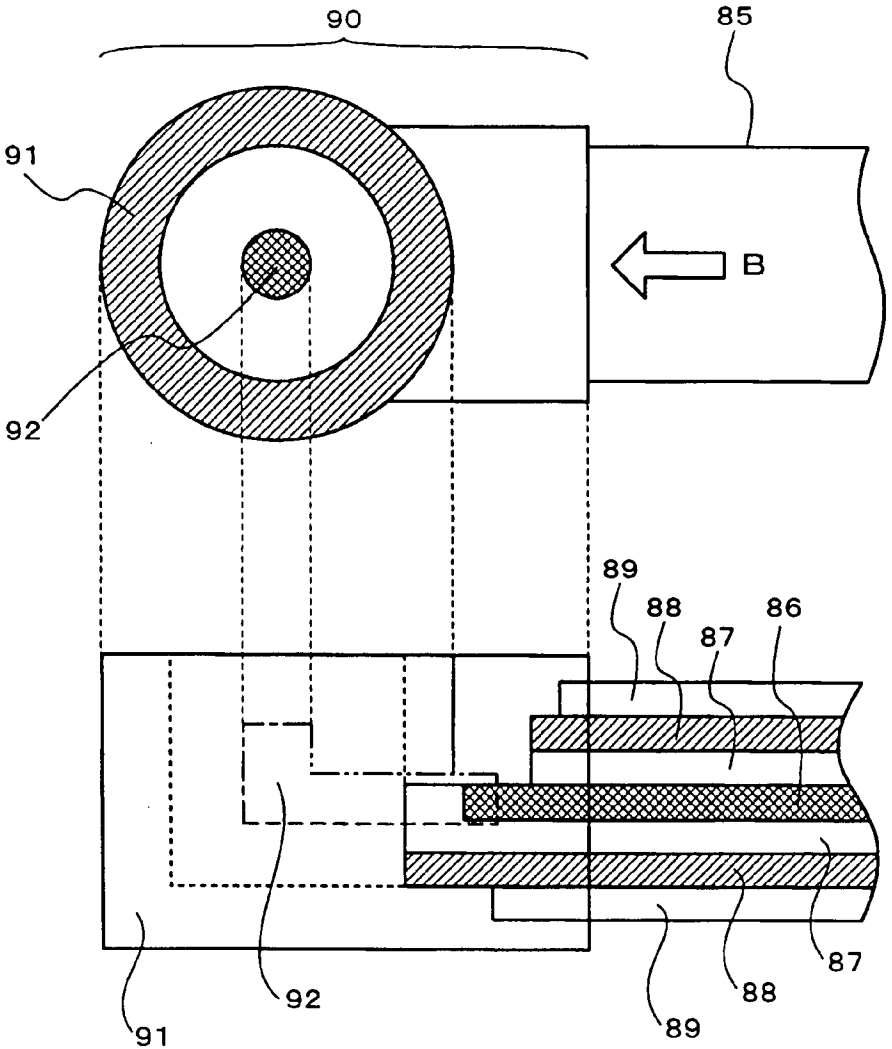
FIG. 11A and FIG. 11B are front and side views, respectively, showing the structure of a flat cable according to a fifth embodiment of the present invention.

Next, with reference to FIG. 11A and FIG. 11B, a flat cable according to a fifth embodiment of the present invention will be described. FIG. 11A and FIG. 11B show a cable 85 according to the present invention along with a connector 90 electrically connected to the cable 85. FIG. 11A is a front view showing the cable 85 and the connector 90. FIG. 11B is a side view showing the cable 85 and the connector 90.

The connector 90 is connected to an end portion of the cable 85 as shown in FIG. 11A and FIG. 11B. A ground terminal 91 of the connector 90 is connected to a ground layer 88 of the cable 85 by, for example, clamping. It is preferred that the ground terminal 91 be connected to two ground layers 88 so that the potentials of the two ground layers 88 become equal. As with the fourth embodiment, through-holes that connect the two ground layers may be formed adjacent to the connector 90.

A mating connector that fits the connector 90 is disposed on a circuit board. When these connectors are connected, the cable 85 and the circuit board can be easily connected.

By inserting the cable 85 into the connector 90 (in the direction of arrow B shown in FIG. 11A), the cable 85 and the connector 90 may be electrically connected. In this case, the cable 85 and the connector 90 may be disconnectable.

(Sixth Embodiment)

Figure 12A:
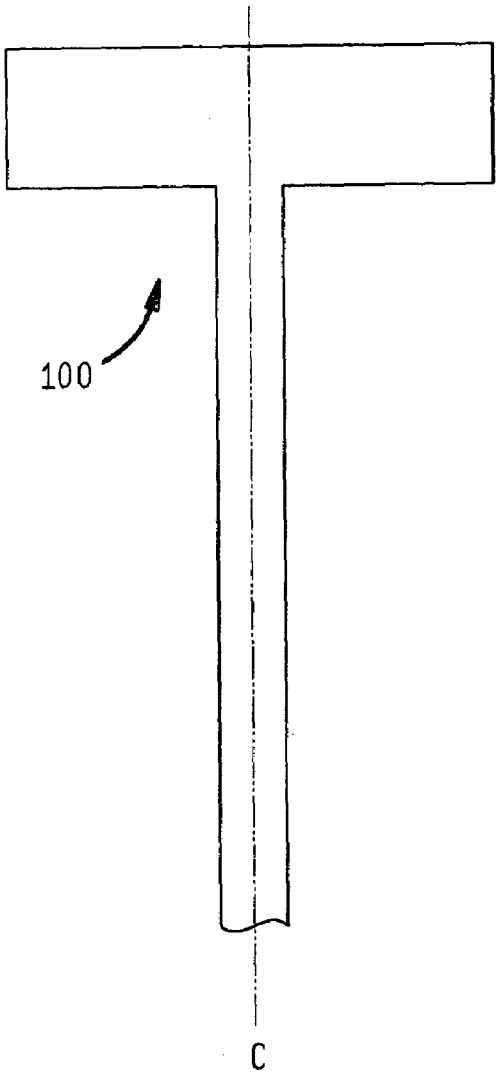
FIG. 12A and FIG. 12B are front and sectional views, respectively, showing the structure of a flat cable according to a sixth embodiment of the present invention.
Figure 12B:
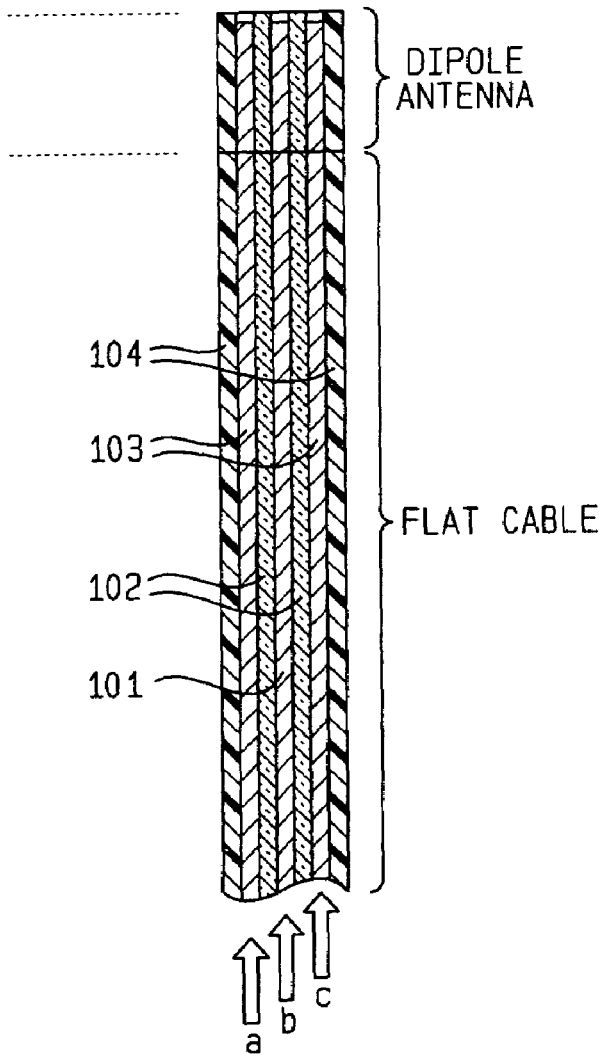

Next, with reference to FIG. 12A, FIG. 12B, FIG. 13A, FIG. 13B and FIG. 13C, a flat cable according to a sixth embodiment of the present invention will be described. This cable is integrated with a dipole antenna. FIG. 12A is a front view showing a cable 100. FIG. 12B is a sectional view showing the cable 100 taken along dotted line C of FIG. 12A. The cable 100 is formed in a T-letter shape. As shown in FIG. 12B, a forward end of the cable 100 functions as a dipole antenna. Connected to the dipole antenna is the flat cable according to the present invention. In addition, as is clear from FIG. 12B, the flat cable is composed of a signal line 101, two dielectric sheets 102, two ground layers 103, and two insulators 104. These structural elements extend to the dipole antenna portion.

Figure 13A:
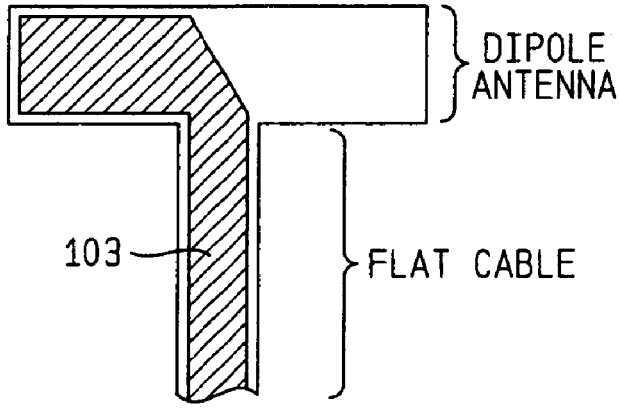
FIG. 13A, FIG. 13B and FIG. 13C are sectional views showing the structure of the flat cable according to the sixth embodiment of the present invention.
Figure 13B:
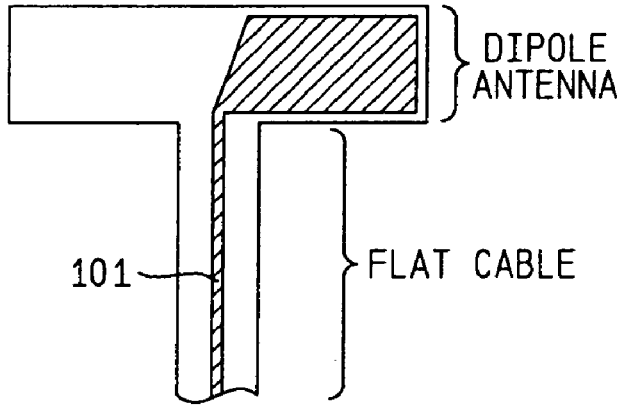
Figure 13C:
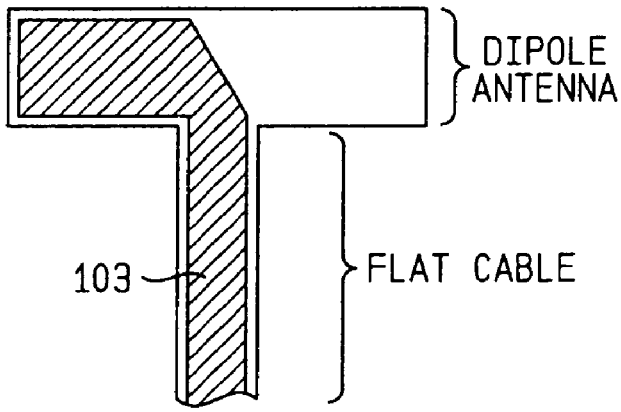

FIG. 13A to FIG. 13C show arrangements of the signal line 101, the two dielectric sheets 102, the two ground layers 103, and two insulators 104, all of which extend to the dipole antenna portion. FIG. 13A is a sectional view showing the flat cable along a layer denoted by arrow a of FIG. 12B (namely, the first ground layer 103). FIG. 13B is a sectional view showing the flat cable along a layer denoted by arrow b of FIG. 12B (namely, the signal line 101). FIG. 13C is a sectional view showing the flat cable along a layer denoted by arrow c shown in FIG. 12B (namely, the second ground layer 103).

FIG. 13A shows that the first ground layer 103 extends from the flat cable to the left of the dipole antenna portion. FIG. 13B shows that the signal line that is narrower than each of the ground layers 103 extends from the flat cable to the right of the dipole antenna portion. FIG. 13C shows that the second ground layer 103 extends to the dipole antenna portion in the same manner as the first ground layer 103 shown in FIG. 13A.

The cable 100 other than the antenna portion is produced in the same manner as the first embodiment shown in FIG. 4A to FIG. 4C and FIG. 5. In addition, the two dielectric sheets 102 are made of a material having, for example, plasticity.

(Seventh Embodiment)

Figure 14A:
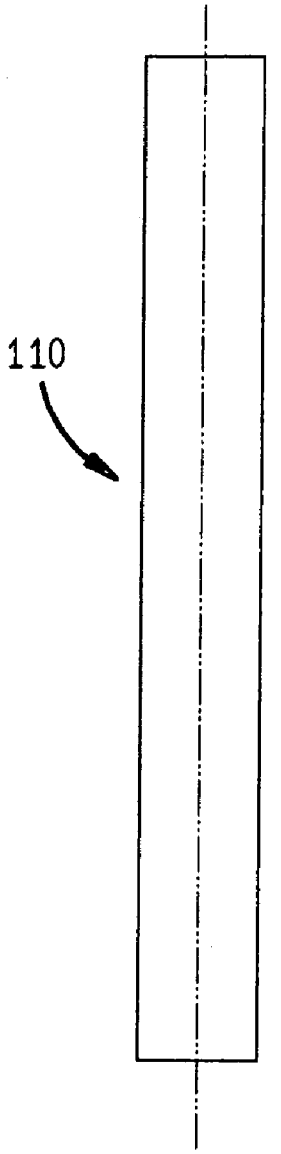
Figure 14A:
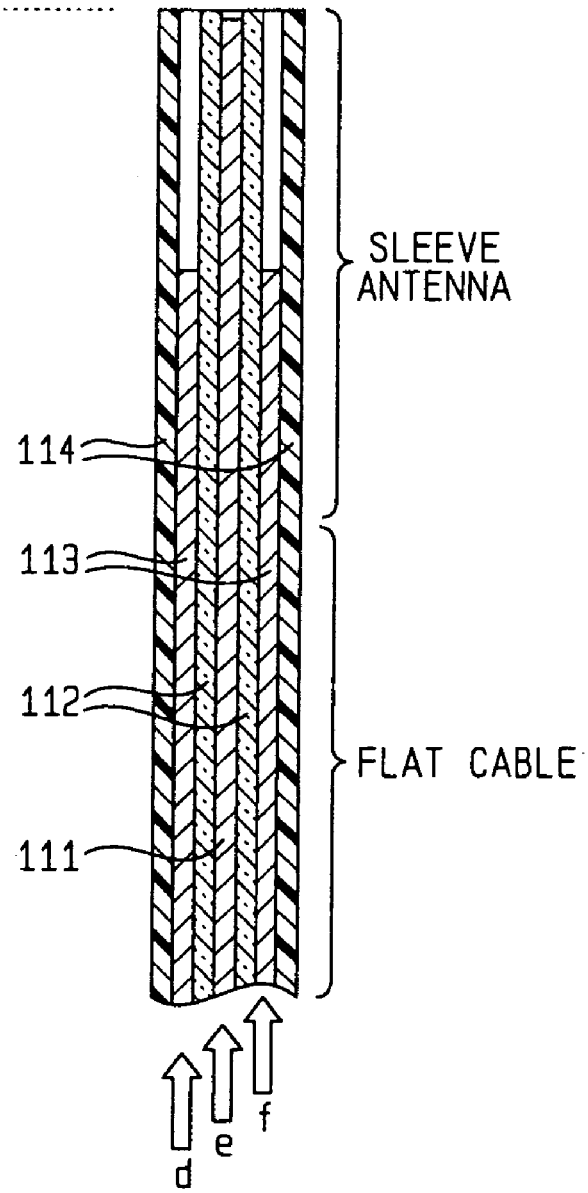

Next, with reference to FIG. 14A, FIG. 14B, FIG. 15A, FIG. 15B and FIG. 15C, a flat cable according to a seventh embodiment of the present invention will be described. This cable is integrated with a sleeve antenna. FIG. 14A is a front view showing a cable 110. FIG. 14B is a sectional view showing the cable 110 taken along dotted line D of FIG. 14A. The cable 110 is formed in a strip shape. As shown in FIG. 14B, a forward end of the cable 110 functions as a sleeve antenna. Connected to the sleeve antenna is the flat cable according to the present invention. In addition, as is clear from FIG. 14B, the flat cable is composed of a signal line 111, two dielectric sheets 112, two ground layers 113, and two insulators 114. These structural elements extend to the sleeve antenna portion.

Figure 15A:
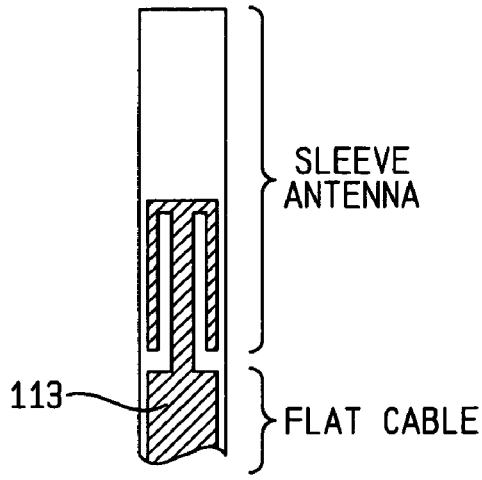
FIG. 15A, FIG. 15B and FIG. 15C are sectional views showing the structure of the flat cable according to the seventh embodiment of the present invention.
Figure 15B:
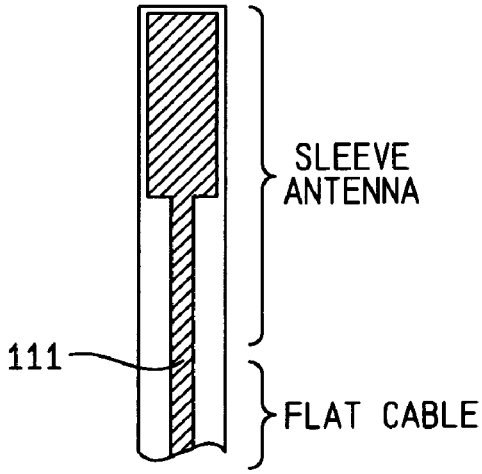
Figure 15C:
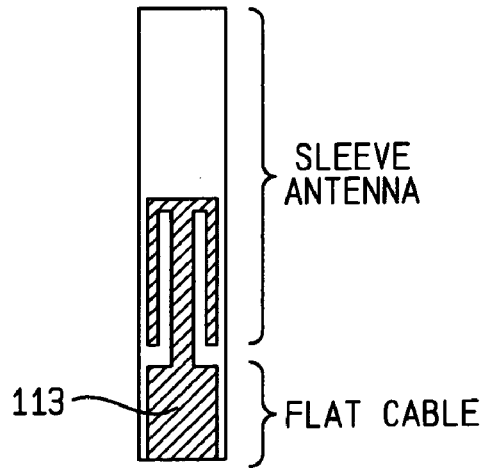

FIG. 15A to FIG. 15C show arrangements of the signal line 111, the two dielectric sheets 112, the two ground layers 113, and the two insulators 114, all of which extend to the sleeve antenna portion. FIG. 15A is a sectional view showing the flat cable along a layer denoted by arrow d of FIG. 14B (namely, the first ground layer 113). FIG. 15B is a sectional view showing the flat cable along a layer denoted by arrow e of FIG. 14B (namely, the signal line 111). FIG. 15C is a sectional view showing the flat cable along a layer denoted by arrow f of FIG. 14B (namely, the second ground layer 113).

FIG. 15A shows that the first ground layer 113 extends from the flat cable to almost the middle position of the sleeve antenna portion. FIG. 15B shows that the signal line 111 that is narrower than each of the ground layers 113 extends from the flat cable to the endmost portion of the sleeve antenna portion. However, from the middle position of the sleeve antenna portion to the endmost portion thereof, the signal line 111 has almost the same width as each of the ground layers 113. FIG. 15C shows that the second ground layer 113 extends from the flat cable to the sleeve antenna portion in the same manner as the first ground layer 113 shown in FIG. 15A.

The cable 100 other than the antenna portion is produced in the same manner as the first embodiment shown in FIGS. 4A to 4C and FIG. 5. The dielectric sheet 102 is made of a material having, for example, plasticity.

Although the cables according to the sixth and seventh embodiments are integrated with specific types of antennas, the flat cables according to the present invention can be integrated with various types of antennas. Thus, the present invention is not limited to the foregoing embodiments. These cables and antennas can be simultaneously produced in the same process.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A flat cable, comprising:

a signal line extending in a longitudinal direction and having an outer periphery;

a dielectric sheet extending in the longitudinal direction to surround the outer periphery of the signal line, the dielectric sheet having a dimension in a width direction orthogonal to the longitudinal direction and a dimension in a thickness direction orthogonal to the longitudinal direction;

a pair of spaced apart ground layers extending in the longitudinal direction and sandwiching the dielectric sheet in the thickness direction; and a first insulator extending in the longitudinal direction to coat the pair of ground layers so that the pair of ground layers are not exposed to the outside, in which one end portion of the flat cable is configured so as to function as an antenna, and in which the signal line and the pair of ground layers extend to the antenna end portion.

2. The flat cable as set forth in claim 1, wherein the signal line has a cross-sectional size in the width and thickness directions and the dielectric sheet has a relative dielectric constant, the cross-sectional size of the signal line, the dimension of the dielectric sheet in the thickness direction, and the relative dielectric constant of the dielectric sheet being selected to obtain a predetermined characteristic impedance for the cable.

3. The flat cable as set forth in claim 1, further comprising:

a pair of spaced apart shield layers extending in the longitudinal direction and sandwiching the first insulator in the thickness direction; and a second insulator extending in the longitudinal direction to coat the pair of shield layers so that the pair of shield layers are not exposed to the outside.

4. The flat cable as set forth in claim 1, wherein the dielectric sheet has plasticity.

5. The flat cable as set forth in claim 1, wherein each of the pair of ground layers has a dimension in the width direction which is substantially larger than a dimension of the signal line in the width direction.

6. The flat cable as set forth in claim 1, wherein one of the ground layers is connected to another of the ground layers by at least one through-hole formed in an end portion of the flat cable.

7. A flat cable, comprising:

a dielectric sheet extending in a longitudinal direction;

a first ground layer formed on a first surface of the dielectric sheet and extending substantially in the longitudinal direction;

a second ground layer formed on the first surface of the dielectric sheet and extending substantially in the longitudinal direction, the second ground layer being spaced apart from the first ground layer;

a signal line formed on the first surface of the dielectric sheet and extending substantially in the longitudinal direction, the signal line being formed between and spaced apart from the first and second ground layers;

a first insulator formed on a first side of the dielectric sheet having the signal line, the first ground layer, and the second ground layer so as to cover the signal line, the first ground layer and the second ground layer; and a second insulator formed on a second side of the dielectric sheet opposite the first side.

8. The flat cable as set forth in claim 7, wherein the dielectric sheet has a dimension in a width direction orthogonal to the longitudinal direction and a dimension in a thickness direction orthogonal to the longitudinal direction, the signal line has a cross-sectional size in the width and thickness directions, and the dielectric sheet has a relative dielectric constant, the cross-sectional size of the signal line, the dimension of the dielectric sheet in the thickness direction, and the relative dielectric constant of the dielectric sheet being selected to obtain a predetermined characteristic impedance for the cable.

9. The flat cable as set forth in claim 7, wherein the dielectric sheet has plasticity.

10. The flat cable as set forth in claim 7, wherein each of the pair of ground layers has a dimension in the width direction which is substantially larger than a dimension of the signal line in the width direction.

11. The flat cable as set forth in claim 7, wherein one of the ground layers is connected to another of the ground layers by at least one through-hole formed in an end portion of the flat cable.

12. The flat cable as set forth in claim 7, further comprising:

an antenna portion integrally connected to one end portion of the flat cable, wherein the signal line and the pair of ground layers extend to the antenna portion.

13. A flat cable sheet, comprising:

a plurality of spaced apart signal lines extending in a longitudinal direction, each signal line having an outer periphery;

a dielectric sheet extending in the longitudinal direction to surround the outer periphery of each of the signal lines, the dielectric sheet having a dimension in a width direction orthogonal to the longitudinal direction and a dimension in a length direction orthogonal to the longitudinal direction;

a pair of spaced apart and non-connecting ground layers extending in the longitudinal direction and sandwiching the dielectric sheet in the thickness direction; and an insulator extending in the longitudinal direction to coat the pair of ground layers so that the pair of ground layers are not exposed to the outside.

14. The flat cable sheet as set forth in claim 13, wherein the flat cable sheet is separable in the longitudinal direction to define a plurality of flat cables, and the signal lines each have a crosssectional size in the width and thickness directions and the dielectric sheet has a relative dielectric constant, the cross-sectional size of each signal line, the dimension of the dielectric sheet in the thickness direction, and the relative dielectric constant of the dielectric sheet being selected to obtain a predetermined characteristic impedance for each of the plurality of flat cables.

15. The flat cable sheet as set forth in claim 13, wherein each of the pair of ground layers is discontinuous so as to define regions extending in the longitudinal direction between adjacent signal lines, the regions being devoid of ground layers, and the flat cable sheet is separable along the regions to define a plurality of flat cables.

16. The flat cable sheet as set forth in claim 13, wherein the dielectric sheet has plasticity.

17. The flat cable sheet as set forth in claim 13, wherein each of the pair of ground layers has a dimension in the width direction which is substantially larger than a dimension of each of the signal lines in the width direction.

18. The flat cable sheet as set forth in claim 13, wherein one of the ground layers is connected to another of the ground layers by a plurality of through-holes formed in an end portion of the flat cable sheet, each through- hole corresponding to one of the signal lines.

19. A flat cable sheet, comprising:

a plurality of spaced apart signal lines extending in a longitudinal direction, each signal line having an outer periphery;

a dielectric sheet extending in the longitudinal direction to surround the outer periphery of each of the signal lines, the dielectric sheet having a dimension in a width direction orthogonal to the longitudinal direction and a dimension in a length direction orthogonal to the longitudinal direction;

a pair of spaced apart and non-connecting ground layers extending in the longitudinal direction and sandwiching the dielectric sheet in the thickness direction;

a first insulator extending in the longitudinal direction to coat the pair of ground layers so that the pair of ground layers are not exposed to the outside;

a pair of spaced apart shield layers extending in the longitudinal direction and sandwiching the first insulator in the thickness direction; and a second insulator extending in the longitudinal direction to coat the pair of shield layers so that the pair of shield layers are not exposed to the outside.

20. The flat cable sheet as set forth in claim 19, wherein the flat cable sheet is separable in the longitudinal direction to define a plurality of flat cables, and the signal lines each have a cross-sectional size in the width and thickness directions and the dielectric sheet has a relative dielectric constant, the cross-sectional size of each signal line, the dimension of the dielectric sheet in the thickness direction, and the relative dielectric constant of the dielectric sheet being selected to obtain a predetermined characteristic impedance in each of the flat cables.

21. The flat cable sheet as set forth in claim 19, wherein each of the pair of ground layers and each of the pair of shield layers is discontinuous so as to define regions extending in the longitudinal direction between adjacent signal lines, the regions being devoid of the ground layers and the shield layers, and the flat cable sheet is separable along the regions to define a plurality of flat cables.

22. The flat cable sheet as set forth in claim 19, wherein the dielectric sheet has plasticity.

23. The flat cable sheet as set forth in claim 19, wherein each of the pair of ground layers has a dimension in the width direction which is substantially larger than a dimension of each of the signal lines in the width direction.

24. The flat cable sheet as set forth in claim 19, wherein one of the ground layers is connected to another of the ground layers by a plurality of through-holes formed in an end portion of the flat cable sheet, each of the through-holes corresponding to one of the signal lines.

25. A method for producing a flat cable sheet, comprising:

providing a first dielectric layer;

depositing a first metal film on a first surface of the first dielectric layer;

etching the first metal film to define a plurality of signal lines that extend substantially parallel to one another in a longitudinal direction;

depositing a second dielectric layer on an exposed surface of the etched metal film;

depositing a second metal film over the second dielectric layer;

etching the second metal film to define a first plurality of spaced apart ground layers extending in the longitudinal direction, each of the ground layers in the first plurality of ground layers overlying one of the signal lines;

depositing a first insulator on an exposed surface of each of the ground layers in the first plurality of ground layers;

depositing a third metal film on a second surface of the first dielectric layer opposite the first surface;

etching the third metal film to define a second plurality of spaced apart ground layers extending in the longitudinal direction, each of the ground layers in the second plurality of ground layers underlying one of the signal lines; and depositing a second insulator on an exposed surface of each of the ground layers in the second plurality of ground layers, in which each of the first plurality of ground layers is spaced apart from and non-connecting to each of the second plurality of ground layers.

26. The flat cable sheet producing method as set forth in claim 25, further comprising:

depositing a fourth metal film over the first insulator;

etching the fourth metal film to define a first plurality of spaced apart shield layers extending in the longitudinal direction, each of the shield layers in the first plurality of shield layers overlying one of the ground layers in the first plurality of ground layers;

depositing a third insulator on an exposed surface of each of the shield layers in the first plurality of shield layers; and depositing a fifth metal film on an exposed surface of the second insulator;

etching the fifth metal film to define a second plurality of spaced apart shield layers extending in the longitudinal direction, each of the shield layers in the second plurality of shield layers underlying one of the ground layers in the second plurality of ground layers; and depositing a fourth insulator on an exposed surface of each of the shield layers in the second plurality of shield layers.

27. The flat cable sheet producing method as set forth in claim 25, wherein each of the ground layers in the first plurality of ground layers and each of the ground layers in the second plurality of ground layers has a dimension in the width direction which is substantially larger than a dimension of each of the signal lines in the width direction.

* * * * *